United States Patent [19]

Bretthauer et al.

[11] 4,425,658

[45] Jan. 10, 1984

[54] CONDUCTOR ARRANGEMENT FOR A THREE-PHASE ELECTRIC ARC FURNACE

[75] Inventors: Karlheinz Bretthauer; Friedhelm Milde, both of Clausthal-Zellerfeld, Fed. Rep. of Germany

[73] Assignee: Fried. Krupp Gesellschaft mit beschränkter Haftung, Essen, Fed. Rep. of Germany

[21] Appl. No.: 351,733

[22] Filed: Feb. 23, 1982

[30] Foreign Application Priority Data

Feb. 24, 1981 [DE] Fed. Rep. of Germany ..... 3106827

[51] Int. Cl.[3] ..... H05B 7/11

[52] U.S. Cl. ..... 373/103

[58] Field of Search ..... 373/103, 48

[56] References Cited

U.S. PATENT DOCUMENTS 3,366,725 1/1968 Watterson ..... 373/103

3,483,300 12/1969 McGee ..... 373/103

FOREIGN PATENT DOCUMENTS 1158419 7/1969 United Kingdom ..... 323/103

762215 9/1980 U.S.S.R. ..... 373/103

*Primary Examiner*—Roy N. Envall, Jr.

*Attorney, Agent, or Firm*—Spencer & Frank

[57] ABSTRACT

An electrode and conductor arrangement for a three-phase electric arc furnace supplied with power from a transformer, including three electrodes which extend downwardly into the furnace, and a plurality of current conducting paths each composed of a rigid conductor, which is conductively connected to a respective electrode and a flexible conductor connected in series between the rigid conductor and the transformer, the rigid conductors extending parallel to one another, the electrodes being spaced from one another in the horizontal direction transverse to the longitudinal axes of the rigid conductors, in which the conducting paths associated with the center electrode are spaced a minimum distance, in the horizontal direction transverse to the longitudinal axes of the rigid conductors, from the conducting paths associated with each of the outer electrodes, there are only two conducting paths, spaced vertically apart, connected to each outer electrode, the vertical spacing between the two conducting paths associated with each outer electrode is greater than the maximum spacing between the actual positions of the electrodes and the positions thereof required to achieve electrical symmetry and associated with identical distances between the lower end of each electrode and its point of connection to its associated rigid conductors; and the distance between the center electrode and the transformer is greater than that between each outer electrode and the transformer, for causing the current flow in the arrangement to be electrically symmetrical and minimizing the line inductances of the conducting paths.

24 Claims, 7 Drawing Figures

CONDUCTOR ARRANGEMENT FOR A THREE-PHASE ELECTRIC ARC FURNACE

BACKGROUND OF THE INVENTION

The present invention relates to an electrode and conductor arrangement for a three-phase electric arc furnace whose electrodes extend vertically or obliquely downwardly into the furnace and are fastened to electrode support arms.

Each of the electrode support arms of a known furnace of this type holds a group of conductors which are connected to the associated electrodes. The conductors connected to the outer electrodes, when seen with respect to the longitudinal axis of the conductors, are arranged perpendicularly on top of one another, while the conductors connected with the center electrode are arranged in the center thereof and axially symmetrically thereto as well as closely above one another.

It is known that electric arc furnaces, for example those used in steel manufacture or for reduction processes, must essentially be able to provide symmetrical current input with substantially equal distribution of the current load to the conductors or conductor parts, and low inductance levels. In addition, they should allow for the smallest possible deviations in height of the current paths, so that their influence on the distribuion of inductance is minimal, and the lowest possible spatial height for the high current paths is maintained.

An asymmetrical current input to an electric arc furnace is associated with unequal, mutual inductive influences which are produced between the high current loops formed by conductors, also called strands, of such a three-phase current system, which usually presents low resistances. It has therefore previously been proposed to attempt to obtain an arrangement whose cross section is as axially symmetrical as possible in the three conductor strands, i.e. to effect a so-called triangulation.

Moreover, there are inductive influences between the conductors, or conductor sections, respectively, in the strands, or high current paths, respectively. The conductor sections carry respectively different current levels thus correspondingly different current densities, resulting, inter alia, in different thermal loads and, finally, higher total losses in the leads. In known systems, the current load differences between conductor sections sometimes reach a ratio exceeding 2:1.

Thus, it is an object of the present invention to optimize the conductor configuration of the conductor sections as well as of the conductor strands in such electric arc furnace.

It is further known that an increased furnace output requires a substantial reduction in the inductances of the high current power leads particularly since an increased output is preferably achieved by increasing the electric arc current intensity. The resulting lower resistance has a considerable influence on the line inductances so that without countermeasures an increased voltage requirement and worsening of cos $\phi$, the power factor, would have to be accepted.

However, every change in the geometry of the current paths of a low-resistance system has a noticeable influence on the distribution of the inductances.

Thus, for example, in electric arc furnaces employing scrap metal for the manufacture of steel, the height levels of the electrodes must be varied considerably during the melting phase so that during this operating phase there inevitably occur deviations in inductance compared to the values for a symmetrical configuration. However, during operation with a calm bath, deviations in height of the supporting arms carrying the conductors cannot be avoided as the electrode mounts should not be attached in the region of the electrode nipples which, as experience has shown, may lead to considerable difficulties.

For example in a triangulated arrangement, these changes in height result in asymmetry of the inductances, with the consequence of a correspondingly asymmetrical furnace operation.

It is therefore a further object of the invention to provide an arrangement in which the deviations in height which result inevitably during operation, and particularly those which result from different attachment of the electrodes, with respect to the theoretically prescribed desired clamp-in length, have the smallest possible effect on the inductance distribution.

A further object of the invention is to limit the spatial height of the high current paths to a minimum value.

It is known in the art that the high intensity current paths of three-phase current electric arc furnaces, including their counterinductances, can be represented by an equivalent circuit diagram of a system with decoupled self-inductances. Consequently, the sum of two equivalent circuit inductances of two strands is equal to the self-inductance of the high current loop formed of the two strands. A lower loop inductance, however, can be achieved by arranging the lines in such a way that the conductors of the three strands lie as close together as possible and the conductors of one strand are disposed vertically above one another. Since, with three juxtaposed strands of the same geometry, it is known that the equivalent circuit inductance of the center strand is always less than that of the outer strands, the above-mentioned spacing rules can be used to realize small system inductances, particularly for the two outer strands.

Accordingly, it has been proposed, as disclosed in German Offenlegungsschrift [Laid-open Application] No. 1,806,504 to arrange preferably three conductors vertically on top of one another for the respective outer electrodes, with the group of conductors associated with one of the outer electrodes being parallel to the other one, and, if necessary, to place the center conductors as close together as possible.

However, the disclosure of that application is limited to the arrangement of the connections of the conductors to the electrode support arms, and does not include any discussion of the succeeding connection to the transformer output, which in part consists of flexible lines, nor about the limits within which the distance dimensions of the individual conductors can vary.

A similar disclosure is provided in British Pat. No. 975,651.

The above and other objects are achieved, according to the invention, in an electrode and conductor arrangement for a three-phase electric arc furnace supplied with power from a transformer, including three electrodes which extend downwardly into the furnace, supporting arms supporting the electrodes, and a plurality of current conducting paths each composed of a rigid conductor, which is fixed to a respective supporting arm and is conductively connected to a respective electrode, and a flexible conductor connected in series between the rigid conductor and the transformer, the rigid conductors extending parallel to one another, the electrodes being spaced from one another in the horizontal direction transverse to the longitudinal axes of the rigid conductors such that two of the electrodes are outer electrodes and the third electrode is a center electrode disposed between the two outer electrodes, a respective plurality of conducting paths being conductively connected to each electrode, the conductors of all conductive paths associated with the same electrode being vertically spaced from one another, the vertical spacing between the conductors associated with the center electrode being less than that between the conductors associated with the outer electrodes, and the conductors associated with the center electrode being positioned between, and axially symmetrically relative to, the conductors associated with the two outer electrodes, by spacing the conducting paths associated with the center electrode a minimum distance, in the horizontal direction transverse to the longitudinal axes of the rigid conductors, from the conducting paths associated with each outer electrode, providing only two conducting paths for each outer electrode; and one or two conducting paths for the center electrode causing the vertical spacing between the two conducting paths associated with each outer electrode to be greater than the maximum spacing between the actual positions of the electrodes and the positions thereof required to achieve electrical symmetry and associated with identical distances between the lower end of each electrode and its point of connection to its associated rigid conductors, and making the distance between the center electrode and the transformer greater than that between each outer electrode and the transformer, for causing the current flow in the arrangement to be electrically symmetrical and minimizing the line inductances of the conducting paths.

The invention thus advantageously relates not only to the conductor arrangement at the electrode supporting arms but also to the electrode arrangement and the conductor arrangement over the entire path from the electrode to the transformer. In particular, the high intensity current paths are each limited to two conductors, which has the advantage over the six-pole arrangement following the supporting arm in German Application No. 1,806,504 that it is much less complicated, provides greater play for the individual conductors during unavoidable or necessary vertical movement of the conductor system and results in a significant reduction of the system inductances or retention of the reduced inductance realized by other measures.

Additionally the arrangement according to the invention includes all parts of the high intensity current paths in achieving the objects of the invention. Preferably, embodiments of the invention utilize a star or delta connection in the transformer or directly at the transformer terminals with fixed geometry and minimum spaces between conductors and lengths of the conductors in the flexible three-pole connection.

Particularly in order to meet the requirement for minimum change in inductance when there is a change in the height of the supporting arms, current is conducted over only two conductors or conductor bundles per strand which, additionally, are spaced apart vertically by a constant distance along their lengths. At the outer electrodes, the vertical distance between the conductors is greater than the maximum distance by which the electrodes, due to unequal consumption and/or technically required attachment, are shifted out of the position which is required with respect to electrical symmetry and which is characterized by identical clamping length for all electrodes. Preferably, the vertical distance, or spacing, between the rigidly held conductors should be about two to three times as large as the maximum distance defined above by which the clamped-in electrode lengths, i.e. the path from the contact jaw of the electrode to its tip, differs from the theoretical optimum length.

Shifting the respective outer conductors further apart results in no improvement in the total inductance value or in the change in inductance, but does contravene the requirement for the lowest possible structural height of the three-phase electric arc furnace. If the spacing between the outer conductors is selected, for example, to be only of the same magnitude as the deviation of the electrode clamping which differs from the optimum position in view of the nipple, the maximum reactance asymmetry may double approximately, compared to the preferably proposed double to triple distance, i.e., for example, a distance 2.5 times as great.

The same effect can be realized for the flexible conductor bundles in the outer strands with only half the vertical spacing compared to the rigid conductors on the supporting arms since the mean vertical displacement between the flexible conductors is only half as great as the vertical displacement between the rigid conductors disposed on the supporting arms.

According to particular features of the invention, if there are deviations in the height of the supporting arms with respect to the optimum position within the maximum permissible values described above, the maximum degrees of asymmetry as they occur with unfavorable relative positions of the supporting arms can be reduced further in that the equivalent circuit inductance of the conductors of the center elctrode is increased by about 4 to 6% with respect to the value which produces symmetry in the normal position of the supporting arms. The maximum asymmetry within the given range is thus reduced, more advantageously, according to theoretical calculations, to about 4/5.

Finally, the structurally greatest possible horizontal approximation of the two outer conductor pairs, which is desirable due to the requirement for a reduction of the equivalent circuit inductances of the outer strands, and optimum vertical spacing between the conductors of one electrode, with which small changes in inductance due to changes in height and a minimum structural height are realized in the dimensioning of a furnace, can bring the result that with the conventional arrangement of the electrodes the equivalent circuit inductance of the center conductors will not reach the value of the two outer conductor pairs and the three-phase system will again become electrically asymmetrical. This difficulty can be overcome by the present invention in that, instead of the conventional electrode arrangement in which the center electrode is held at a supporting arm which is shorter than those holding the two outer electrodes, an arrangement is used in which the center electrode is held by a longer supporting arm which is brought through between the two outer electrodes.

Advantageously the locations where the electrodes are clamped to the supporting arms lie at equispaced points in a horizontal plane and always at the same distance from the vertical longitudinal axis of the furnace. The described arrangement has two advantages: firstly, the symmetry of the three-phase system is re-established by this measure; secondly, the equivalent circuit inductances of the outer conductors are reduced by a further degree.

The unavoidable differences in height with respect to the normal height position are known to produce additional inequalities in the distribution of the currents to the conductors or bundles of conductors connected to the electrodes. This can be avoided by vertically crossing the conductors of each electrode. An optimum crossover point lies in the vicinity of the connecting point between the flexible conductors and the rigidly arranged conductors on the supporting arms for each electrode, where such crossing can also be effected particularly favorably from a structural point of view.

A further similar cross-over point is the point of connection between the flexible conductors and the rigid conductors on the transformer side. This is appropriate if, for structural reasons, the center rigid conductor tube length on the transformer side is substantially greater than the vertical spacing between the outer conductors.

Advantageously, the vertical offset produced by the crossing of the conductors due to the different height arrangement of the flexible conductors is compensated by the introduction of an extension piece of corresponding length which is fastened to the lower rigid conductor. According to a further feature of the invention, the lower flexible conductor of each pair, which is connected with the upper rigid conductor, is supported by the lower rigid conductor, e.g. on the supporting arm of the respective electrode, via an insulating piece.

The requirement for uniform current distribution to the conductors connected to an electrode is automatically met for the normal height position of the supporting arms with respect to the rigid conductors if the point of connection between a rigid conductor and its associated flexible conductor is an electrically conductive one and, additionally, if the conductor or conductors for the center electrode are precisely centered horizontally as well as vertically with respect to the conductors of the two outer electrodes. Because of the curved paths followed by the flexible conductors, this position, which is called the normal height position, also does not produce equality in the current loads for the flexible conductors so that breaking or eliminating the electrically conductive connections at the above-mentioned connection points produces a current distribution which results in less unequal distribution in the entire system.

In conventional power lead arrangements the tubes making up a conductor run are joined to one another at the ends at which the flexible conductors are connected. In this way both the flexible conductors and the tubes of each run form galvanically closed current loops. If the connection from the lower to the upper tube is cut and the current path is crossed over at the tube—flexible conductor junction so that only one single current loop is obtained for each conductor run from the connection of the flexible conductors on the transformer to the electrode holders, then current distribution via the groups of conductors becomes considerably more uniform. The current then flows from the lower flexible conductor to the upper tube and from the upper flexible conductor to the lower tube of a phase.

DESCRIPTION OF THE PREFERRED EMBODIMENTS

Figure 1:
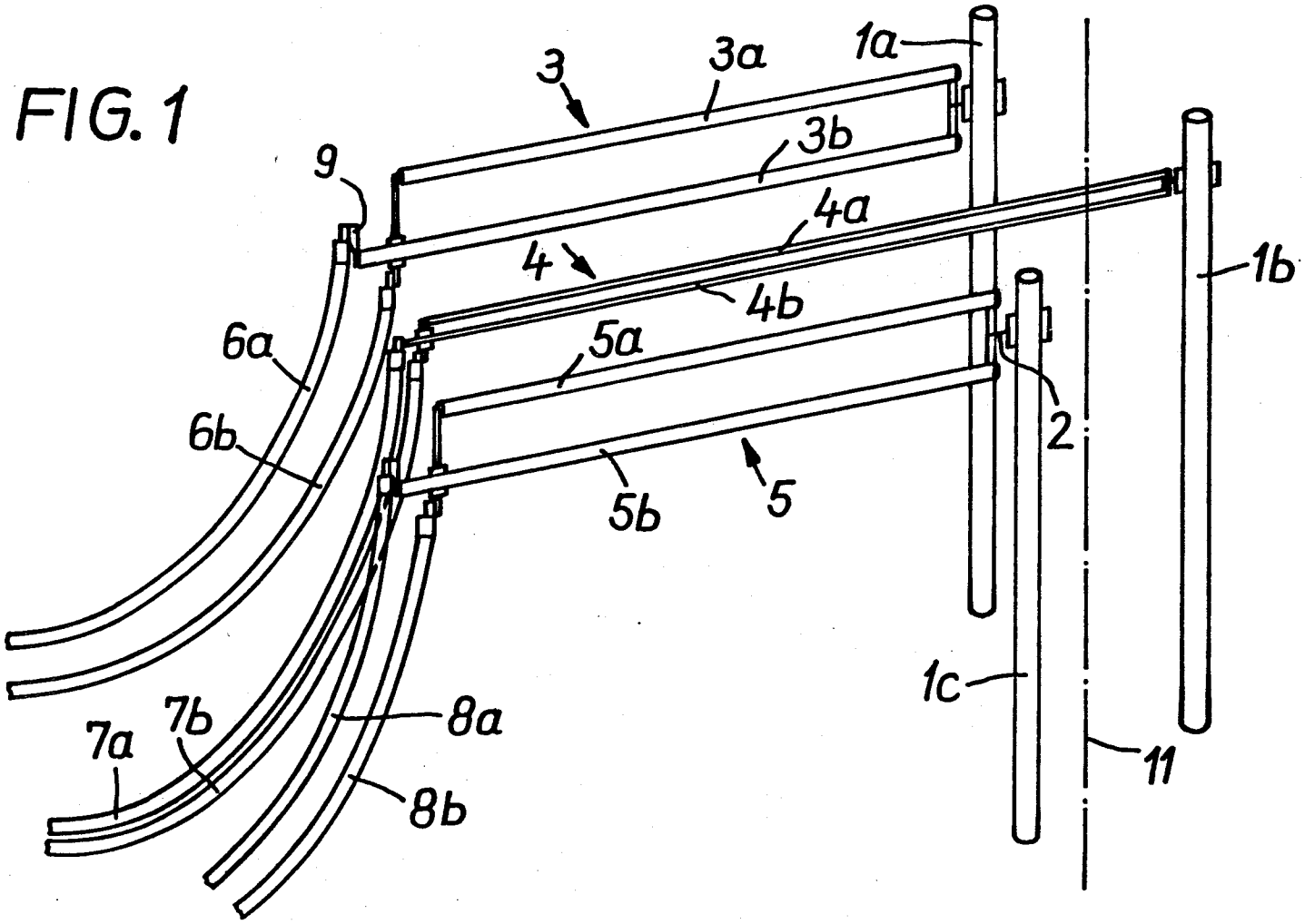
FIG. 1 is a perspective view of the electrode and conductor arrangement according to a preferred embodiment of the invention.

The arrangement shown in FIG. 1 includes electrodes 1*a*, 1*b* and 1*c* which are held at respective electrode supporting arms 2. A respective conductor pair 3, 4, or 5 of rigid, vertically superposed conductors 3*a* and 3*b*, 4*a* and 4*b*, or 5*a* and 5*b*, respectively, is further fastened to each of the electrode supporting arms 2, or each supporting arm includes such a conductor pair held in position relative to one another by spacers.

The conductors 3*a*–5*b* are followed, via corresponding connections, by likewise vertically superposed pairs of flexible conductors 6*a* and 6*b*, 7*a* and 7*b*, and 8*a* and 8*b*. The vertical spacing between conductors 4*a* and 4*b*, or 7*a* and 7*b*, respectively, which are connected with the center electrode 1*b*, has been selected to be as small as possible. The conductors of conductive paths connected to each electrode cross one another at the points of connection between the associated flexible and rigid conductors.

The lower rigid conductor 3*b*, 4*b* or 5*b*, of each lower supporting arm portion is longer than the associated conductor 3*a*, 4*a* and 5*a*, thereabove, so that the flexible conductors associated with each electrode extend from the points of connection to the transformer to the associated rigid conductors while remaining parallel to one another. The resulting inequality between the length of the flexible conductors of each pair, as a result of this vertical offset, particularly in the case of the outer conductor pairs 6 and 8, is compensated by an extension piece 9 attached at the associated lower rigid conductor, or supporting arm portion.

Figure 1A:
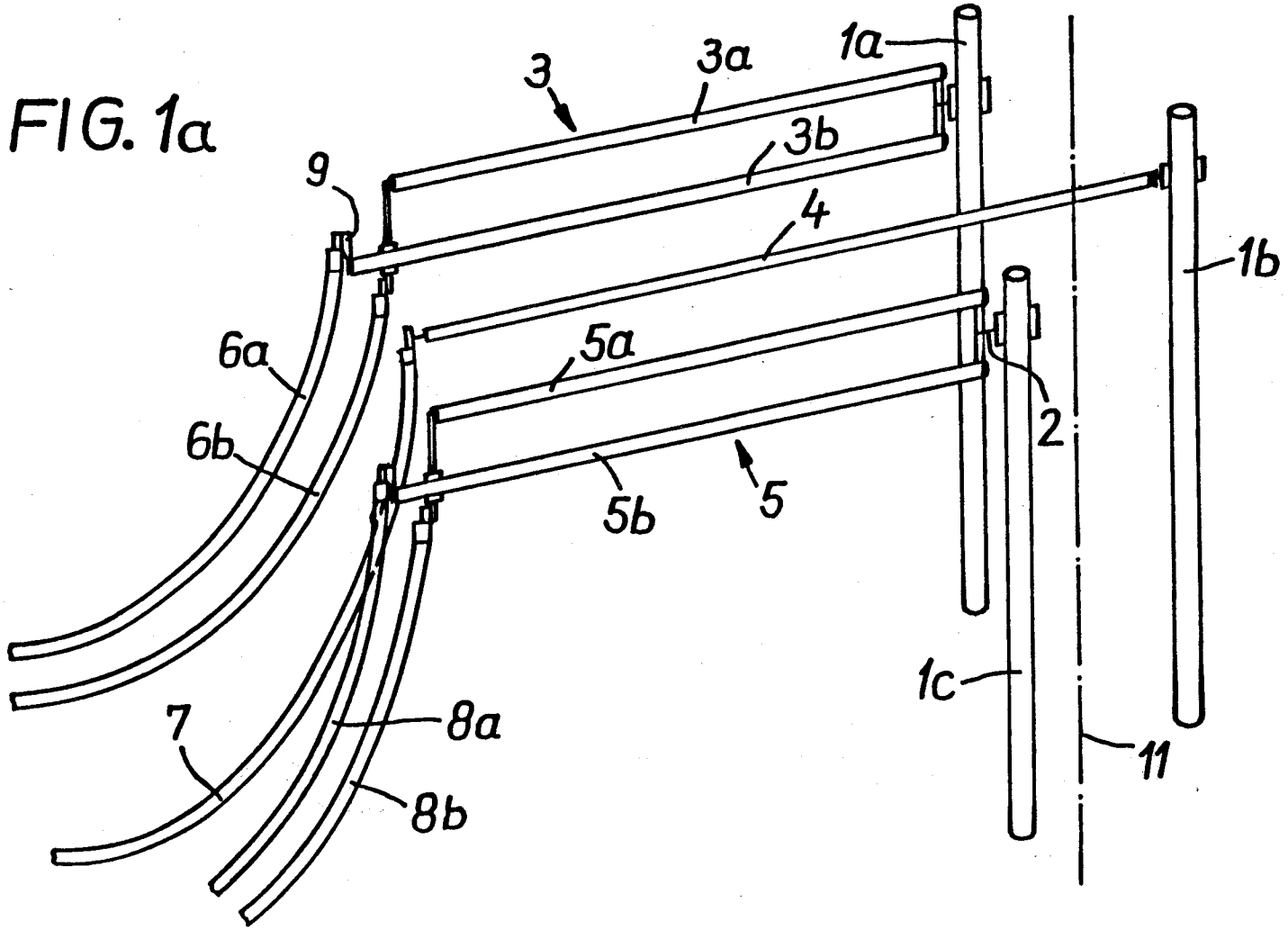
FIG. 1*a* is a view similar to that of FIG. 1 of a modified form of the preferred embodiment of the invention.

The arrangement shown in FIG. 1*a* differs from that shown in FIG. 1 only in that the center conductor consists of a single rigid conductor 4 and a single flexible conductor 7 constituting a single conductive path for electrode 1*b*.

Figure 3:
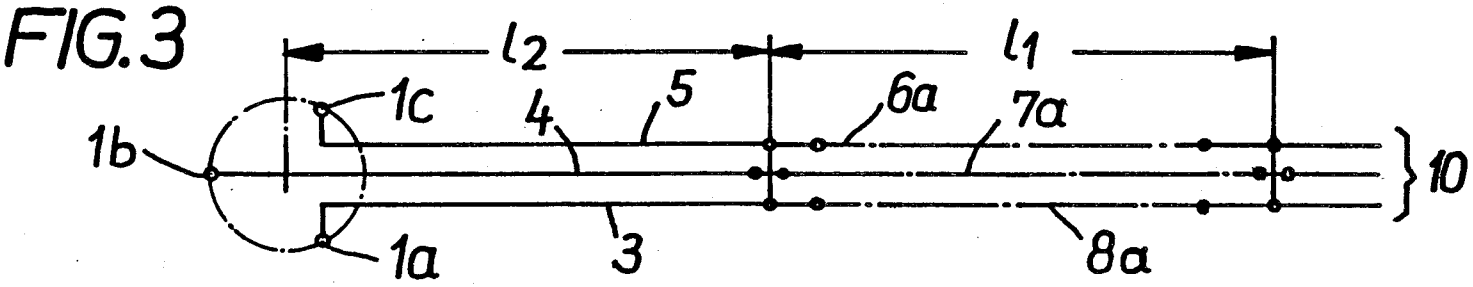
FIG. 3 is a simplified top plan view of the embodiment of FIG. 1.

The locations of attachment of the supporting arms 2 to the electrodes 1*a*, 1*b* and 1*c*, as well as the arrangement of the electrodes attached vertically at these points, when seen in a top view, form an isosceles triangle which is symmetrical to the vertical longitudinal axis 11 of the furnace, as shown in FIG. 3.

Figure 2:
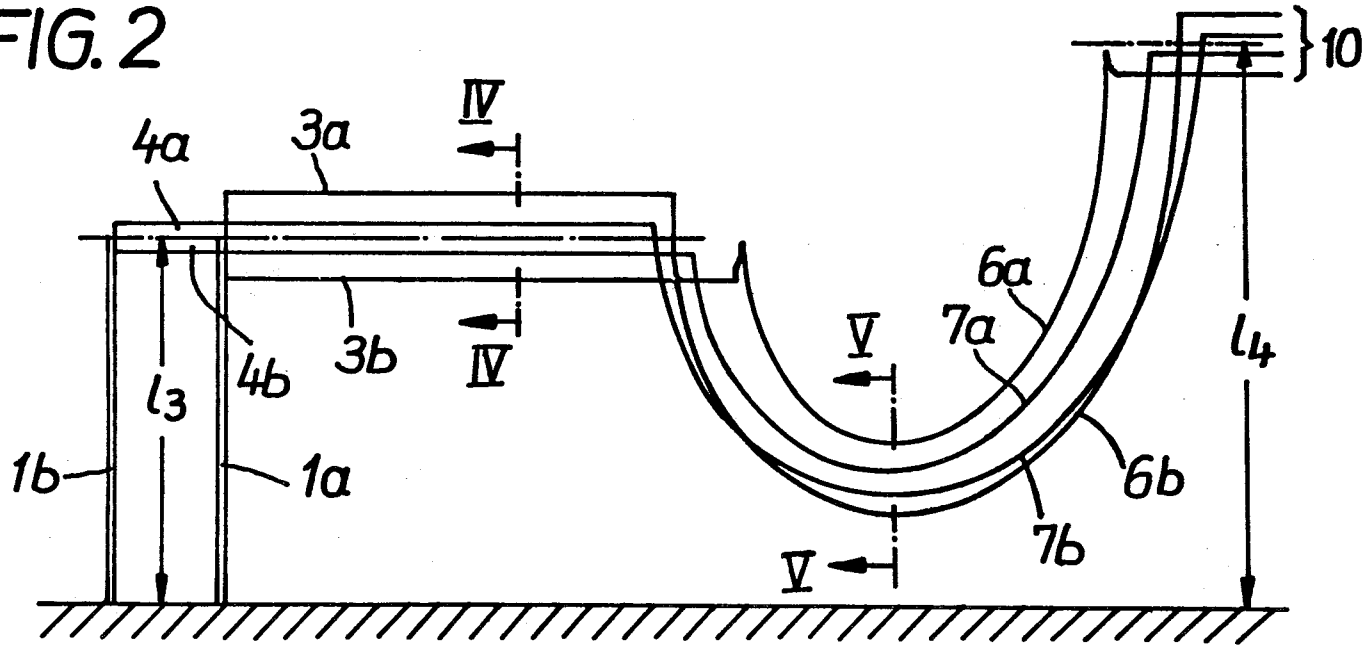
FIG. 2 is a simplified side elevational view of the embodiment of FIG. 1.

FIGS. 2 and 3 are simplified pictorial side and top views, respectively, of the conductor arrangement between the conductors 10 fixed at the transformer end and the vertically oriented electrodes 1*a*, 1*b* and 1*c*. In the arrangement shown in FIG. 2, the outer rigid conductors 3*a* and 3*b*, as well as conductors 4*a* and 4*b*, are horizontally extending, vertically superposed, or spaced, tubes mounted on the associated supporting arms 2. The similarly vertically superposed, or spaced, flexible conductors 6*a*, 6*b* and 7*a*, 7*b*, respectively, are conductor cables. The rigid conductors 4*a* and 4*b* connected to the center electrode 1*b* are also provided in the form of tubes which also extend horizontally and are spaced apart vertically, but compared to the abovedescribed outer electrode arrangement, are placed closer together in the vertical direction, or as a substitute can consist of a single tube 4 as shown in FIG. 1*a*. The electrode 1*b* is arranged to be spatially as far removed as possible from the transformer and in such a manner that the conductors 4*a* and 4*b* pass between the conductor pairs 3 and 5 and are spaced equidistantly from those conductor pairs. Finally, the conductors 4*a* and 4*b* are connected to the transformer via the flexible conductors 7*a* and 7*b*.

An embodiment that has been reduced to practice was constructed to have the following dimensions, the locations of which are shown in FIGS. 2–6:

| | |
|---|---|
| Distance between the transformer conductors 10 and the points of connection of the flexible conductors 6b and 8b with their associated rigid conductors, | $l_1$ = 4000 mm |
| Distance between the latter points of connection and the longitudinal axis 11 of the furnace, | $l_2$ = 6175 mm |
| Vertical spacing between tip of center electrode and its point of connection to conductors 4, | $l_3$ = 4200 mm |
| Average vertical spacing between the transformer terminals and the plane of the electrode tips, | $l_4$ = 5700 mm |
| Total length of each of the flexible cables 6a through 8b, | $l_5$ = 8000 mm |
| Vertical spacing between the rigid outer conductors of each pair, | e = 1000 mm |
| Horizontal spacing between each pair of outer rigid conductors and the rigid conductors connected with the center electrode 1b, | h = 400 mm |
| Vertical spacing between the rigid conductors connected with the center electrode 1b, | f = 110 mm |
| Spacing, in the vertical plane, between the flexible outer conductors of each pair, | a = 500 mm |
| Horizontal spacing between each pair of flexible outer conductorsand the flexible conductors 7a, 7bconnected with the center electrode, | t = 400 mm |
| Spacing, in the vertical plane, between the flexible conductors 7a, 7b connected to the center electrode, | b = 260 mm |
| Assumed maximum shift of the electrode supporting arms, | ± 400 mm |
| cables used in all flexible conductors, | 13 single conductors each having a cross-sectional area of 400 $mm^2$ |
| outer diameter of the tube constituting each rigid outer conductor, | 180 mm |
| outer diameter of the tube constituting each rigid center conductor, | 100 mm |
| cross-sectional area of each rigid conductor, | 5200 $mm^2$ |

Figure 4:
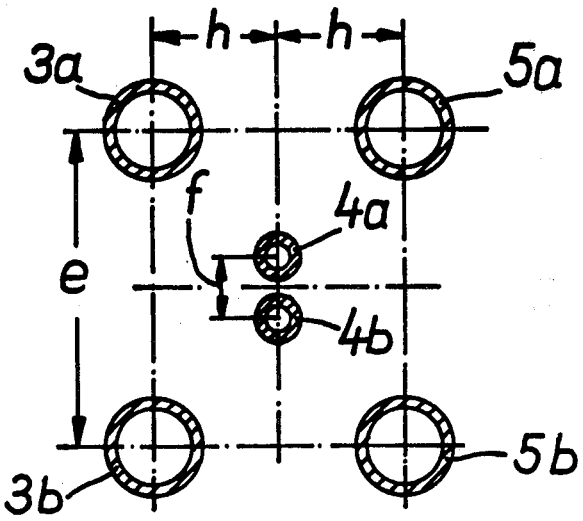
FIG. 4 is a cross-sectional detail view taken along the line IV—IV of FIG. 2.
Figure 5:
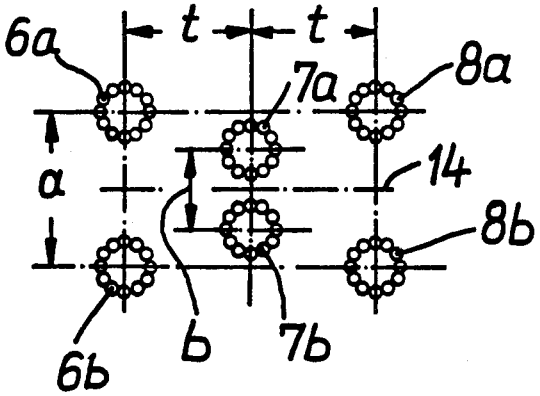
FIG. 5 is a cross-sectional detail view taken along the line V—V of FIG. 2.

The dimensional parameter of the conductor arrangement shown in principle in FIGS. 4 and 5 is listed in the above table for a special embodiment.

FIG. 4 shows that the outer conductors 3*a* and 3*b* as well as 5*a* and 5*b* are disposed vertically above one another and the resulting conductor pairs 3 and 5 are arranged parallel to one another. In the square formed by the above-mentioned outer conductors 3*a*, 3*b*, 5*a* and 5*b*, when seen in cross section, the conductors 4*a* and 4*b* connected to the center electrode 1*b* are arranged in an axially symmetrical manner. With a view toward low total inductance, the outer conductors 3*a*, 3*b*, 5*a* and 5*b* are preferably thin walled and have large outer diameters, while the conductors 4*a*, and 4*b*, which are arranged with a close vertical spacing from one another at opposite sides of the center, or point of intersection of the diagonals, of the above-mentioned square, have the smallest possible outer diameters and may possibly be replaced by a single tube 4 as shown in FIG. 1*a*.

In the event that only one rigid conductor is used for the center run, it should be disposed centrally in relation to the outer conductors. Its external diameter should be as small as possible, but its cross-sectional area must be adequate for the current load.

Upon a comparison of the arrangement of conductors 3*a* through 5*b* shown in FIG. 4 with the arrangement of the flexible conductors 6*a*, 6*b*, 7*a*, 7*b*, 8*a* and 8*b* shown in FIG. 5 the spacing between the flexible conductors 6*a* and 6*b* or 8*a* and 8*b*, respectively, of each outer pair is always less than that between the associated rigid conductors of each outer pair. With reference to the arrangement whose dimensions are listed in the above table, the conductor spacing a, for example between conductors 6*a* and 6*b*, is only half as large as the conductor distance e, for example between conductors 3*a* and 3*b*. The lateral horizontal distances h and t between the respective conductors connected with the center electrode and the outer conductors are kept small with the aim of reducing inductances and are identical throughout the length of the conductor arrangement.

Figure 6:
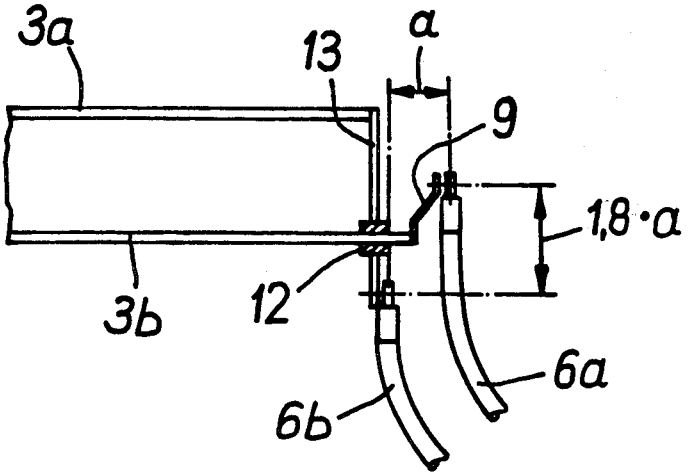
FIG. 6 is a side elevational, detail view of the connection of a flexible conductor pair to the rigid conductors of an outer electrode in the embodiment of FIGS. 1–5.

FIG. 6 shows the connection of the flexible conductors, here, for example, the outer conductors 6*a* and 6*b*, to the corresponding rigid conductors, here 3*a* and 3*b*. Similar to FIGS. 1 and 2, the vertical crossing of the conductors is evident. Conductor 3*a* is connected to conductor 6*b* and conductor 3*b* is connected to conductor 6*a*.

The connection of conductor 6*b* to conductor 3*a* is effected via a conductive bar 13 which is mechanically fastened to the rigid conductor 3*b* but is electrically isolated therefrom by means of an insulating member 12. The flexible conductor 6*a* is connected to the conductor 3*b* via an extension piece 9 which is inclined upwardly from conductor 3*b* to conductor 6*a*. This extension piece 9 is dimensioned to provide the required vertical offset between the points of connection of cables 6*a* and 6*b*. In the present case, this offset has a value of approximately 1.8a, where a is the dimension shown in FIGS. 5 and 6, with the aim of producing the shortest possible connection length from the terminals of the rigid conductors 3*a*, 3*b* to the secondary terminals of the transformer.

For the pair of conductors leading to the center electrode 1*b*, there is also provided a cross-over having the form shown in FIG. 6. Since the average connection length from the rigid conductors 4*a* and 4*b* to the secondary terminals of the transformer is somewhat larger than that of the outer conductors, due to the outwardly offset cable connections, as shown in FIGS. 2 and 3, a length equalization is realized here, if cables of identical length are used for all conductors, in that the extension piece 9 shown in FIG. 6 is made shorter or is possibly omitted completely.

If only one rigid tube is used as the conductor to the center electrode 1*b*, the electrically conductive connection of the two terminals of cables 7*a* and 7*b*, if two cables are used, with that tube is effected in the customary manner known in the art. The crossing of the conductors at the transformer side of cables 6, 7 and 8, as shown in FIG. 2, corresponds for each conductor pair to the illustration in FIG. 6.

According to one variation of the geometric arrangement shown in FIG. 5, the conductors are displaced in the region of the essentially vertically extending ends of each flexible conductor 6*a*, 6*b*, 7*a*, 7*b*, 8*a* and 8*b*, to such an extent that the center line 14 between the two flexible conductors *7a* and *7b* of the center conductor pair lies at the same height as the lower flexible conductors *6b* and *8b* of the outer conductor pairs.

In practice the requirement for uniformity of clamped electrode length, which is defined as the distance between the contact blocks and the tip of the electrode, cannot always be met. Deviations arise principally from the fact that in practice clamping of the electrode close to the nipple connection is avoided, as a result of which it may be necessary to put up with a clamped electrode length which deviates, to the extent required by the electrode dimensions, from the clamped length giving ideal symmetry. Minor deviations also result from uneven electrode consumption. For the largest electrodes in general use, with a diameter of 60 cm, a deviation of ±40 cm can result. A vertical spacing between the rigid outer conductors of each pair of $e=2.5\times 40$ cm $=100$ cm is thus produced.

The concept of electrical asymmetry is seen here in each case against a different background. If the tube conductors which belong to the middle phase are moved closer together than is necessary for electrical symmetry in the normal position of the support arms, then the degree of asymmetry which arises in the least favourable case on variation in level of the 3 support arms by ±40 cm is again improved. Here it is a question of judgement as to whether one prefers accurate design electrical symmetry or whether one will accept a slight asymmetry and can thereby reduce still further the degree of asymmetry when the height position of the support arms is changed.

It will be understood that the above description of the present invention is susceptible to various modifications, changes and adaptations, and the same are intended to be comprehended within the meaning and range of equivalents of the appended claims.

What is claimed is:

1. In an electrode and conductor arrangement for a three-phase electric arc furnace supplied with power from a transformer, comprising: three electrodes which extend downwardly into the furnace; supporting arms supporting said electrodes; and means defining a plurality of current conducting paths each composed of a rigid conductor, which is fixed to a respective supporting arm and is conductively connected to a respective electrode, and a flexible conductor connected in series between said rigid conductor and the transformer, said rigid conductors extending parallel to one another, said electrodes being spaced from one another in the horizontal direction transverse to the longitudinal axes of said rigid conductors such that two of said electrodes are outer electrodes and the third electrode is a center electrode disposed between said two outer electrodes, at least one conducting path being conductively connected to said center electrode and a respective group of conducting paths being conductively connected to each said outer electrode, the conductors of all conducting paths associated with the same outer electrode being vertically spaced from one another, and the conductors associated with said center electrode being positioned between, and axially symmetrically relative to, the conductors associated with said two outer electrodes, the improvement wherein:

said at least one conducting path associated with said center electrode is spaced a minimum distance, in the horizontal direction transverse to the longitudinal axes of said rigid conductors, from said conducting paths associated with each said outer electrode;

there are only two said conducting paths connected to each said outer electrode and there are no more than two said conducting paths connected to said center electrode;

the vertical spacing between said two conducting paths associated with each said outer electrode is greater than the maximum spacing between the actual positions of said electrodes and the positions thereof required to achieve electrical symmetry and associated with identical distances between the lower end of each electrode and its point of connection to its associated rigid conductors; and the distance between said center electrode and the transformer is greater than that between each said outer electrode and the transformer, for causing the current flow in said arrangement to be electrically symmetrical and minimizing the line inductances of said conducting paths.

2. An arrangement as defined in claim 1 wherein the vertical spacing between said rigid conductors associated with each said outer electrode is two to three times as large as said maximum spacing.

3. An arrangement as defined in claim 1 wherein the vertical spacing between said flexible conductors associated with each said outer electrode is approximately 40 to 60% of the vertical spacing between said rigid conductors associated with each said outer electrode.

4. An arrangement as defined in claim 1 wherein the vertical spacing between said flexible conductors associated with each said outer electrode is approximately 50% of the vertical spacing between said rigid conductors associated with each said outer electrode.

5. An arrangement as defined in claim 1 wherein said two conducting paths associated with each said outer electrode cross at least once in the vertical direction.

6. An arrangement as defined in claim 5 wherein each said conducting path further includes a second rigid conductor connected in series between its associated flexible conductor and the transformer, and the location at which said paths associated with each said outer electrode cross is in the region where said flexible conductors are connected to said second rigid conductors.

7. An arrangement as defined in claim 5 wherein the location at which said paths cross is in the region where said flexible conductors are connected to said rigid conductors.

8. An arrangement as defined in claim 7 wherein, in said conducting paths associated with each said outer electrode, the lower one of said flexible conductors is connected to the upper one of said rigid conductors, and further comprising insulating means supporting the lower one of said flexible conductors at the lower one of said rigid conductors in an electrically insulated manner at the location at which said paths cross.

9. An arrangement as defined in claim 5 or 7 wherein said flexible conductors associated with one said outer electrode extend to respectively different heights at their ends connected to their associated rigid conductors, and further comprising a conductive extension piece connected between one said flexible conductor associated with said one outer electrode and its associated rigid conductor to compensate for such difference in height.

10. An arrangement as defined in claim 1 wherein said rigid conductors associated with said outer electrodes are thin-walled tubes having a large outer diameter.

11. An arrangement as defined in claim 1 wherein said at least one rigid conductor associated with said center electrode has the smallest possible outer diameter.

there are two said conducting paths associated with said center electrode and spaced vertically from one another, the vertical spacing between said two conducting paths associated with said center electrode is less than the value corresponding to that creating electrical symmetry among all of said conducting paths for increasing the inductance of said conducting paths associated with said center electrode in order to minimize the maximum electrical asymmetry which can occur in said arrangement.

13. An arrangement as defined in claim 12 wherein the inductance of said conducting paths associated with said center electrode is increased by about 5%.

14. An arrangement as defined in claim 1 wherein there are two said conducting paths associated with said center electrode and spaced vertically from one another, and said flexible conductors associated with said center electrode have their ends which are connected to their respective rigid conductors positioned axially asymetrically relative to the corresponding ends of said flexible conductors associated with said outer electrodes for improving the equality of current distribution among said conducting paths.

15. An arrangement as defined in claim 14 wherein, at said ends of said flexible conductors connected to their respective rigid conductors, said ends of said flexible conductors associated with said center electrode are positioned symmetrically relative to a line joining the centers of the lower ones of said flexible conductors associated with said two outer electrodes.

16. An arrangement as defined in claim 1 wherein each said electrode is clamped to a respective supporting arm at a point, and the points at which said three electrodes are clamped lie in a common horizontal plane and are horizontally equidistant from one another and from the vertical axis of the furnace.

17. An arrangement as defined in claim 1 wherein there are two said conducting paths associated with said center electrode and spaced vertically from one another, and the vertical spacing between the conductors associated with said center electrode is less than that between the conductors associated with each said outer electrode.

18. An arrangement as defined in claim 17 wherein said rigid conductors associated with said center electrode have the smallest possible outer diameter.

19. An arrangement as defined in claim 17 wherein said two conducting paths associated with each said electrode cross at least once in the vertical direction.

20. An arrangement as defined in claim 19 wherein each said conducting path further includes a second rigid conductor connected in series between its associated flexible conductor and the transformer, and the location at which said paths cross is in the region where said flexible conductors are connected to said second rigid conductors.

21. An arrangement as defined in claim 19 wherein the location at which said paths cross is in the region where said flexible conductors are connected to said rigid conductors.

22. An arrangement as defined in claim 2 wherein, in said conducting paths associated with each said electrode, the lower one of said flexible conductors is connected to the upper one of said rigid conductors, and further comprising insulating means supporting the lower one of said flexible conductors at the lower one of said rigid conductors in an electrically insulated manner at the location at which said paths cross.

23. An arrangement as defined in claim 1 wherein there is only one said conductive path connected to said center electrode.

24. An arrangement as defined in claim 1 wherein said electrodes are located at positions which differ from those required to achieve electrical symmetry and associated with identical distances between the lower end of each said electrode and its point of connection to its associated rigid conductor.

* * * * *